United States Patent [19]

Kobayashi

[11] Patent Number: 5,067,427

[45] Date of Patent: Nov. 26, 1991

[54] SEMI-SUBMERGED WATER VEHICLE

[75] Inventor: Noboru Kobayashi, Iwata, Japan

[73] Assignee: Yamaha Hatsudoki Kabushiki Kaisha, Iwata, Japan

[21] Appl. No.: 562,715

[22] Filed: Aug. 6, 1990

[30] Foreign Application Priority Data

Aug. 9, 1989 [JP] Japan ..... 1-207749

[51] Int. Cl.[5] ..... B63B 1/00

[52] U.S. Cl. ..... 114/56; 114/66; 440/6

[58] Field of Search ..... 114/312, 314, 313, 337, 114/338, 363, 330–333, 123, 61, 283, 66; 440/6

[56] References Cited

U.S. PATENT DOCUMENTS

| | | | |
|---|---|---|---|
| 832,646 | 10/1906 | Wiebe | 114/333 X |
| 2,377,442 | 6/1945 | Osterhoudt | 114/338 X |
| 4,320,713 | 3/1982 | Nishida et al. | 114/123 |
| 4,494,472 | 1/1985 | Rougerie | 114/66 |
| 4,565,149 | 1/1980 | Clasky et al. | 114/264 |
| 4,841,896 | 6/1989 | Fury | 114/330 X |

FOREIGN PATENT DOCUMENTS 62-221991 9/1987 Japan .

*Primary Examiner*—Ed Swinehart
*Attorney, Agent, or Firm*—Ernest A. Beutler

[57] ABSTRACT

A semi-submerged water vehicle having a small rider's compartment designed to accommodate primarily a single rider that can operate the watercraft in either a standing or a seated position. There is provided both an underwater porthole and an above-the-water porthole both of which can be looked through by the operator when seated within the passenger compartment so as to afford both above-the-water and under-the-water viewing to the rider.

16 Claims, 9 Drawing Sheets

SEMI-SUBMERGED WATER VEHICLE

BACKGROUND OF THE INVENTION

This invention relates to a semi-submerged water vehicle and more particularly to a water vehicle that can be operated by an operator and will travel generally above the water but in which the operator may view either underwater scenes or above-water scenes.

There is a well-known type of watercraft that operates generally in a submerged state and which enables its passengers to view underwater scenes. Such water vehicles are, however, relatively expensive. Therefore, this type of vehicle is normally priced out of the range that permits large sales volumes. In addition, water vehicles that are designed to be operated primarily in a submerged state are generally not particularly maneuverable when operating in a normal mode.

It is, therefore, a principal object of this invention to provide an improved water vehicle which permits the operators to view underwater scenes but which does not have to be capable of being fully submerged.

It is a further object of this invention to provide a semi-submerged water vehicle that permits its occupants to view both scenes above the water and beneath the water.

It is yet another object of this invention to provide an improved semi submerged water vehicle that will be very maneuverable in its normal operation.

SUMMARY OF THE INVENTION

This invention is adapted to be embodied in a semi-submerged watercraft having a hull defining a rider's compartment for accommodating a single rider seated below the water level. A hatch is positioned above the water level for entry and exit of the watercraft. The hull has an .underwater porthole through which the rider may view underwater scenes when seated in the rider's compartment and a further porthole above the water through which the seated rider may determine his course when seated in the rider's compartment for operating the watercraft.

DETAILED DESCRIPTION OF THE PREFERRED EMBODIMENT OF THE INVENTION

Figure 1:
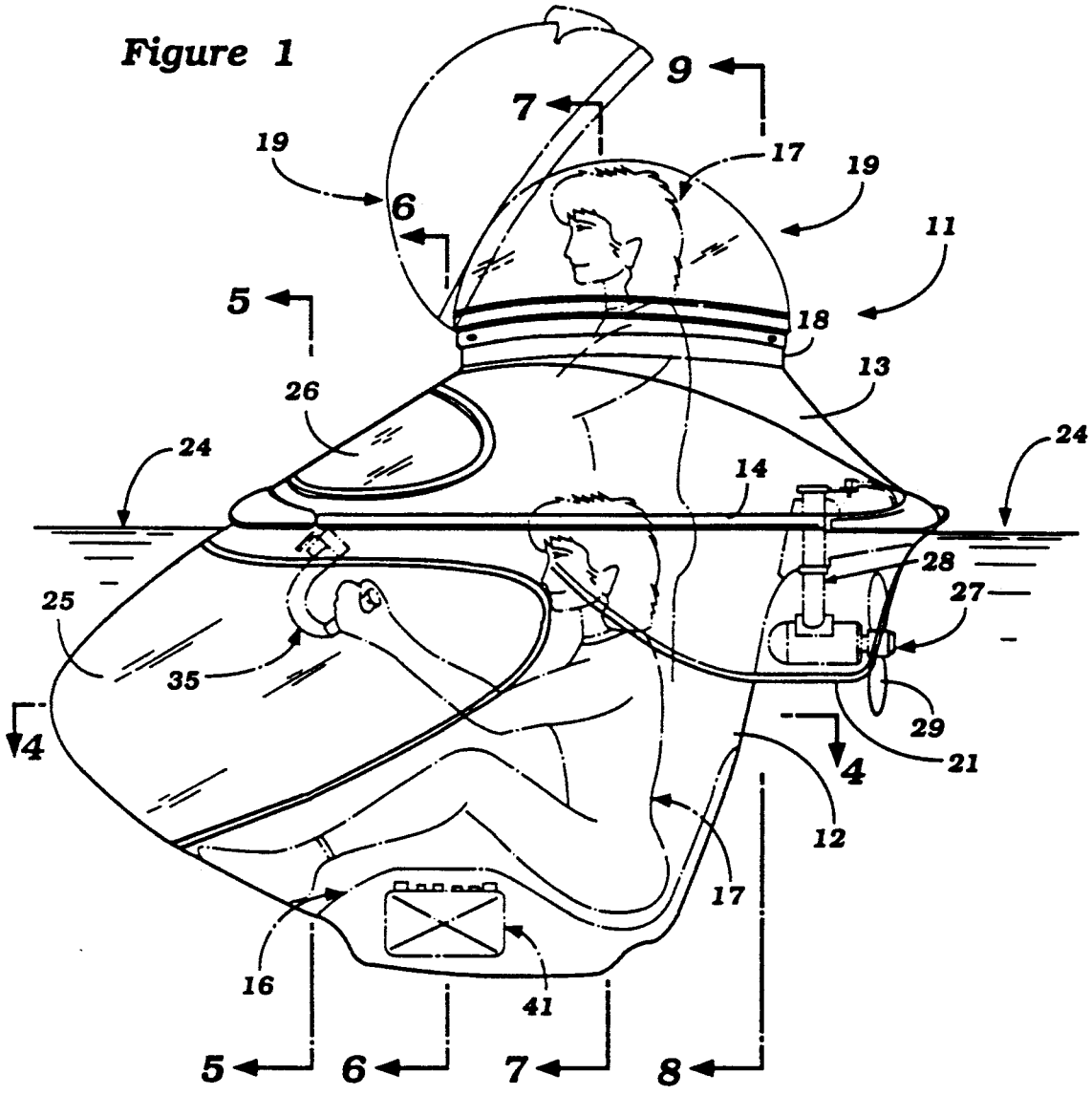
FIG. 1 is a side elevational view of a semi-submerged watercraft constructed in accordance with an embodiment of the invention with the operator shown in both a sitting and standing mode and with the hatch cover both closed and opened (in phantom).
Figure 2:
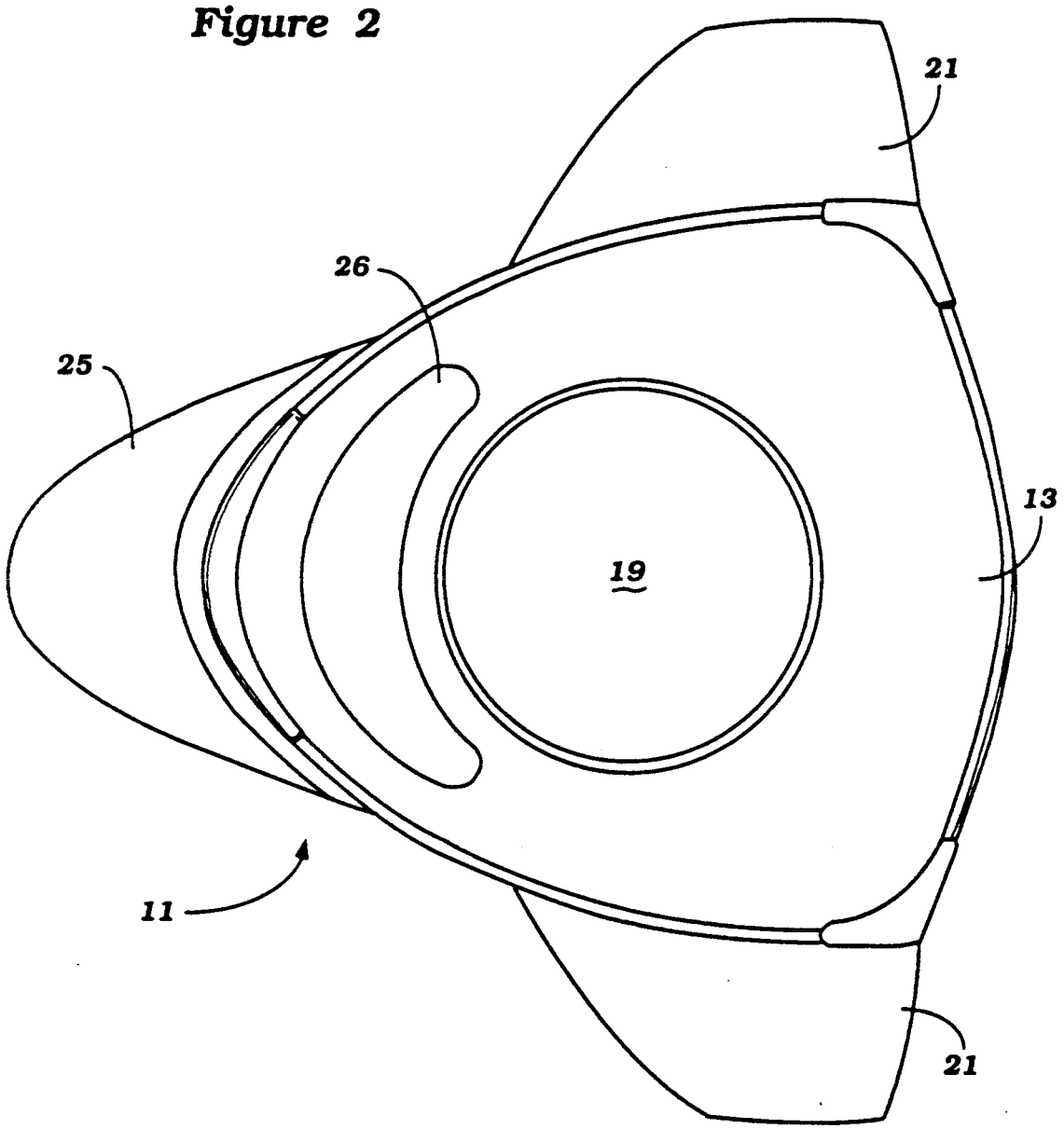
FIG. 2 is a top plan view of the watercraft.

Turning now in detail to the drawings, a semi-submerged watercraft constructed in accordance with an embodiment of the invention is identified generally by the reference numeral 11. The watercraft 11 is comprised of a hull made up of a lower hull portion 12 and an upper hull portion 13. The hull portions 12 and 13 are formed from a suitable material such as a fiberglass-reinforced resinous plastic and are joined together at their mating edges by a peripheral seam 14 that may be formed in any known manner. Hull portions 12 and 13 define a passenger compartment, indicated by the reference numeral 15, which is preferably sized to be relatively small and only contain either a single operator or alternatively an operator and a few passengers. In the illustrated embodiment, however, a single rider compartment 15 is illustrated since this is a preferred form of the invention.

The lower part of the rider's compartment 15 is provided with a form-fitting seat 16 on which an operator, shown in phantom and identified by the reference numeral 17, may normally operate the watercraft from a seated position There is provided at the upper part of the hull portion 13 a hatch 18 that is closed by a hatch cover, indicated generally by the reference numeral 19 so as to permit the operator 17 to enter and exit the water vehicle.

Figure 7:
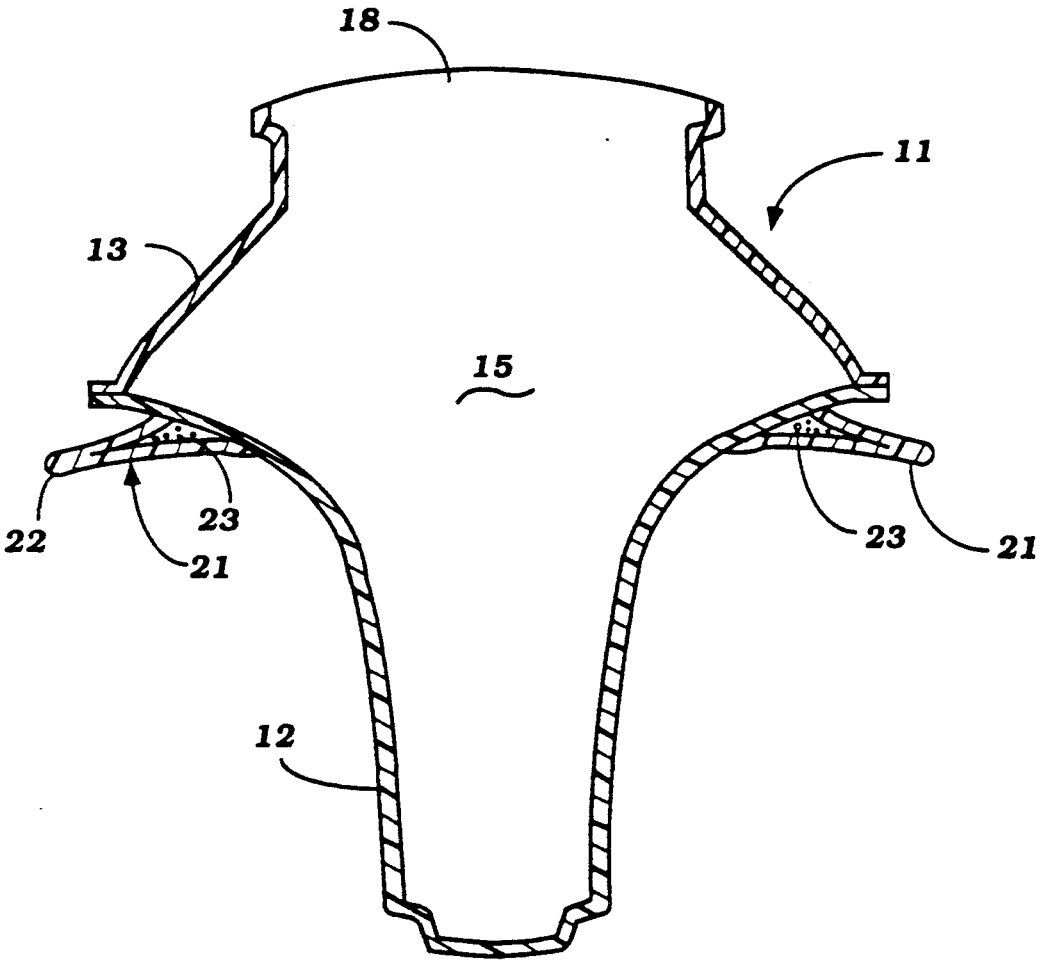
FIG. 7 is a cross sectional view taken along the line 7—7 of FIG. 1.
Figure 8:
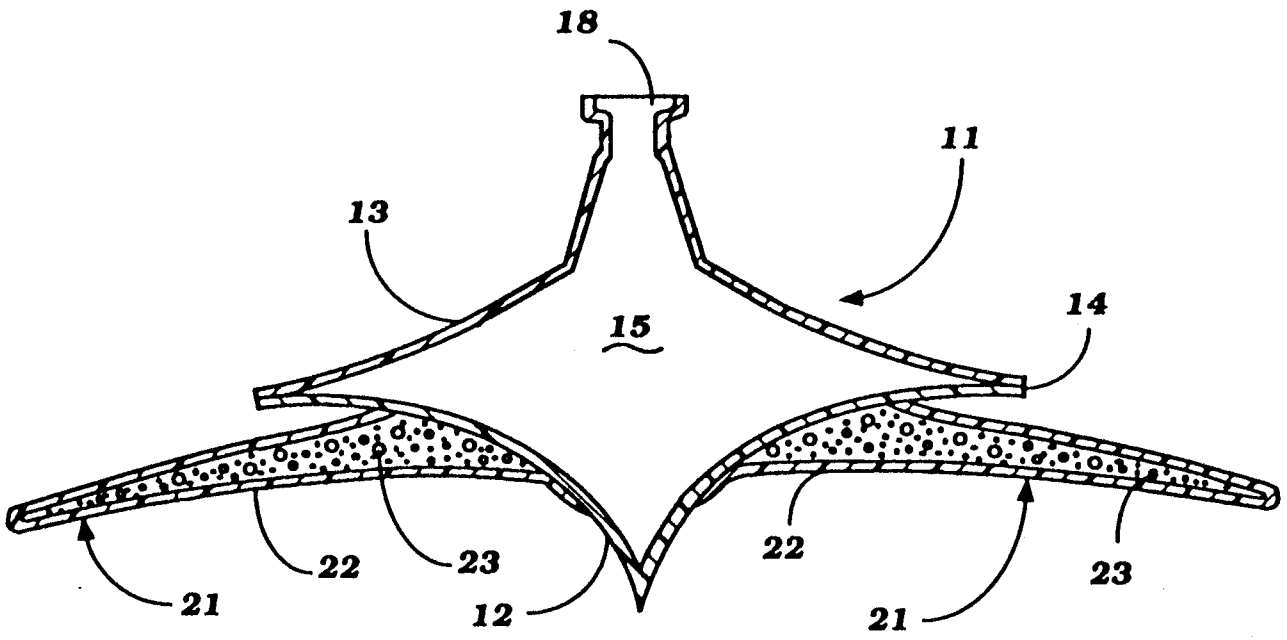
FIG. 8 is a cross sectional view taken along the line 8—8 of FIG. 1.

The hull is provided with a pair of stabilizing wing-like floats 21 that extend outwadly just slightly below the joint 14 between the upper and lower hull portions 12 and 13. That is, the floats 21 are affixed to the lower hull portion 12. As may be best seen in FIGS. 7 and 8, the floats 21 have an outer peripheral surface 22 which is formed from a fiberglass reinforced resin and which has a hollow interior which is filled with a flotation material such as styrofoam or the like 23. In addition to adding buoyancy to the watercraft 11, the floats 21 also provide stability for it.

Figure 3:
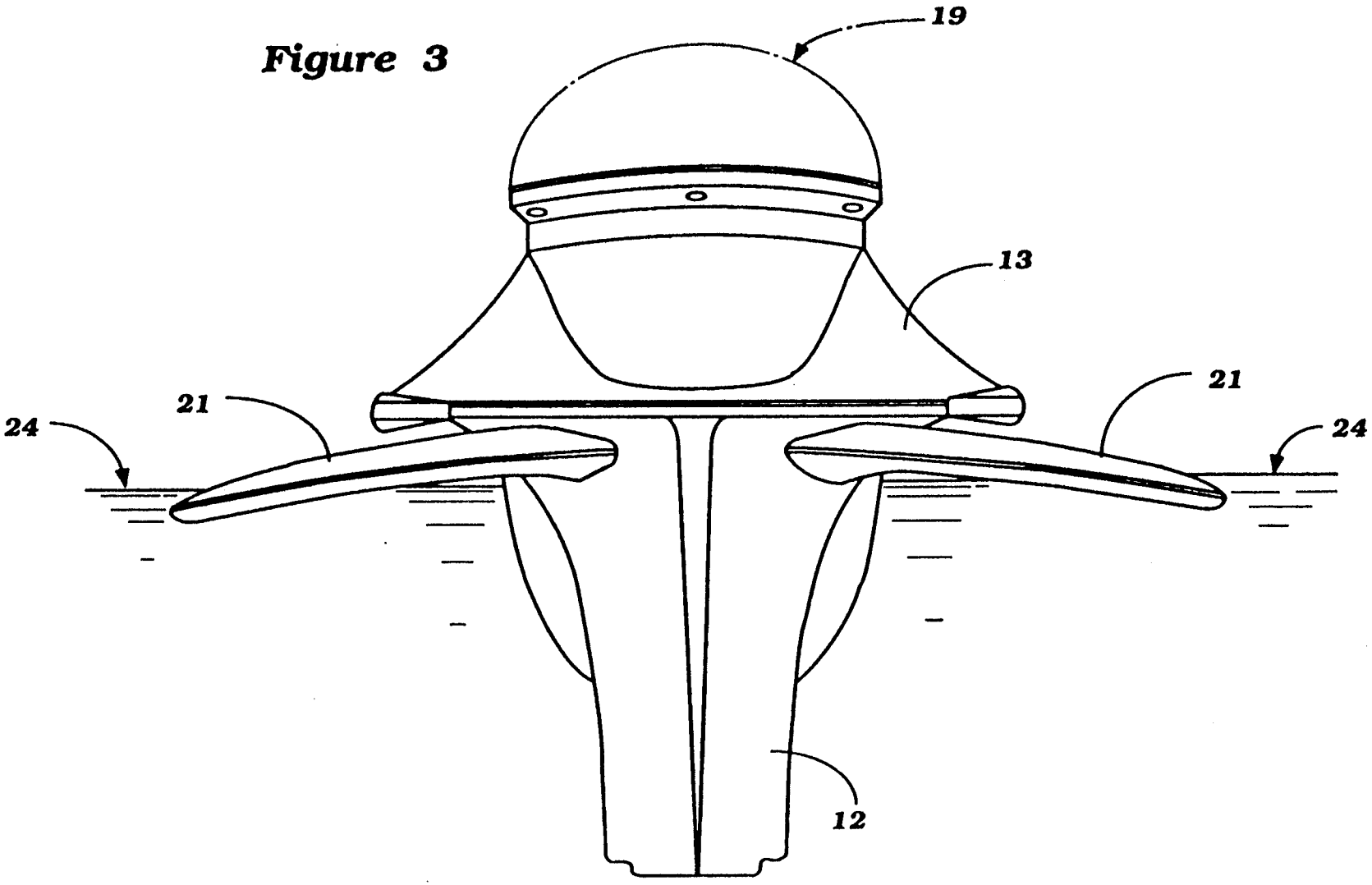
FIG. 3 is a front elevational view of the watercraft.
Figure 4:
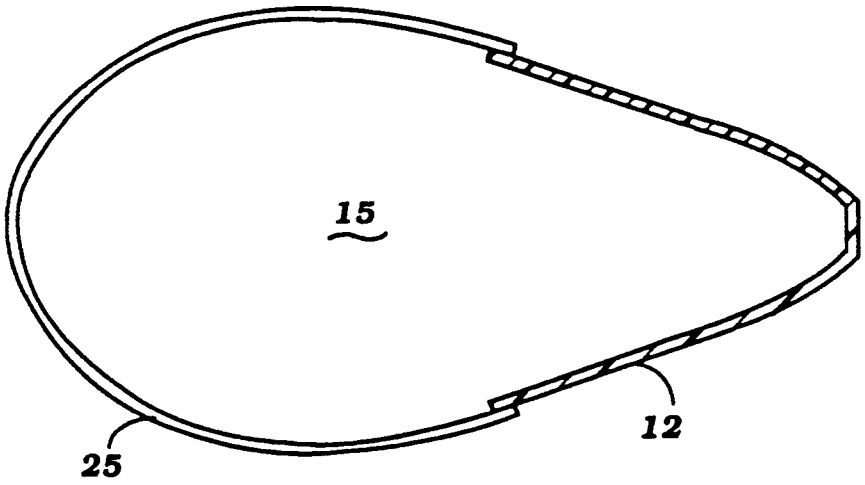
FIG. 4 is a cross sectional view taken through the hull of the watercraft and along the line 4—4 of FIG. 1.
Figure 5:
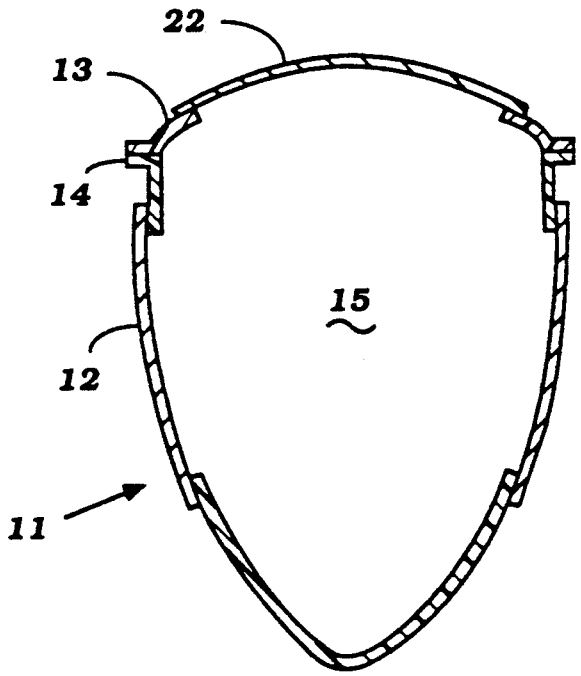
FIG. 5 is a cross sectional view taken along the line 5—5 of FIG. 1.
Figure 6:
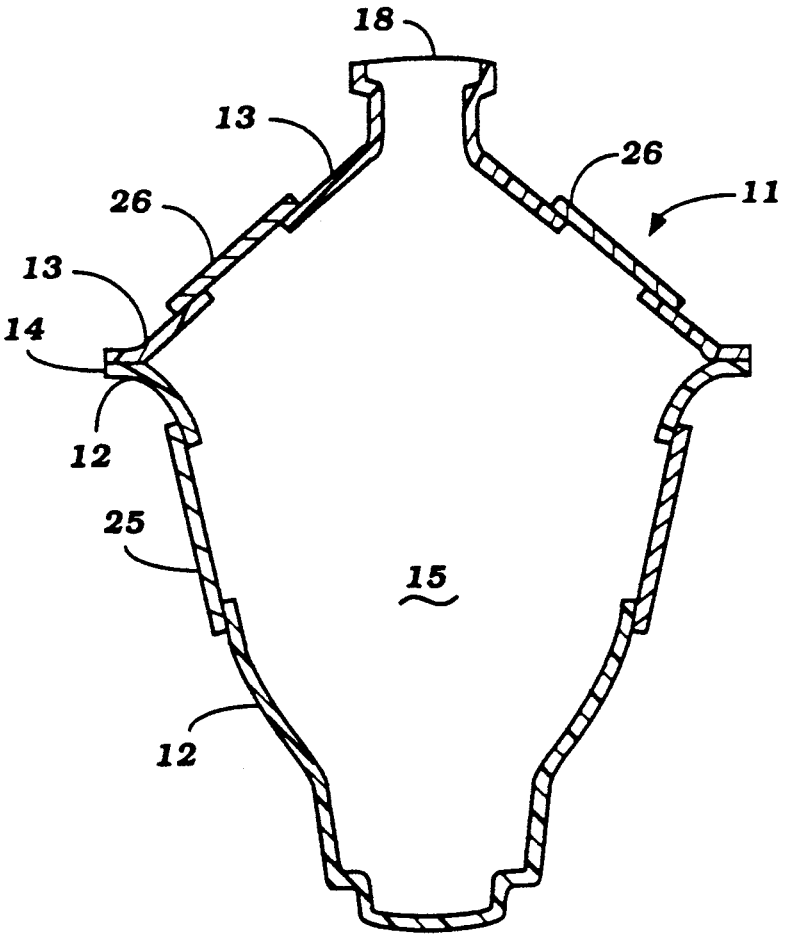
FIG. 6 is a cross sectional view taken along the line 6—6 of FIG. 1.

It should be noted that the lower hull portion 14 is generally the only portion of the watercraft which is normally submerged as seen by the normal water line 24 in FIGS. 1 and 3. That is, the upper hull portion 13 and hatch 18 and hatch cover 19 are positioned above the water line 24 when the watercraft 11 is fully loaded. As may be seen from FIG. 4, the watercraft and particularly the lower hull portion 12 has a generally teardrop shape in a horizontal cross-sectional view so that it will offer good passage through the water and a high degree of stability and maneuverability.

The lower hull portion 12 is provided with a forwardly facing, substantially large porthole 25 that is formed by a transparent window which may be formed either from glass or any of the high-strength, lightweight plastic materials. When the operator 17 is seated in the seat 16, he may readily view underwater scenes through this underwater porthole 25. The underwater porthole 25, as may be readily scene from the Figures, wraps around a substantial portion of the sides of the lower hull portion 12 so as to give the operator 17 a wide underwater view.

The upper hull portion 13 is also provided with a porthole 26, which like the porthole 25, :may be closed by suitable transparent materials such as glass or any of the known lightweight, high-strength transparent plastics. The porthole 26 is positioned so that the seated operator 17 may also readily view above-the-water scenes so as to navigate and operate the watercraft 11 while seated. Thus, the operator can be quite comfortable and nevertheless observe both underwater scenes and above-the-water scenes for navigational purposes while seated.

Figure 9:
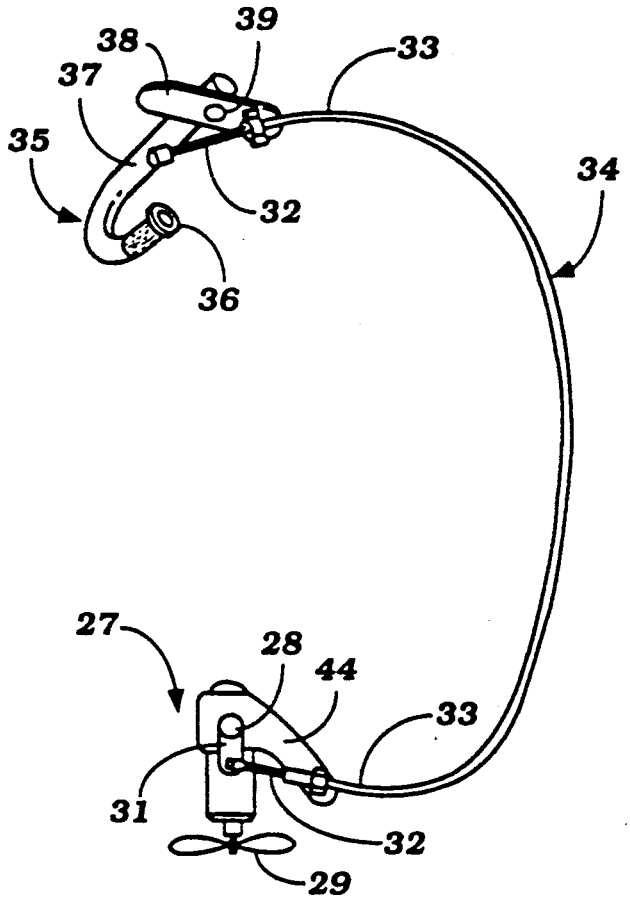
FIG. 9 is a view showing the control for the propulsion unit of the watercraft.

Although any suitable power source may be employed, conveniently the watercraft 11 is powered by an electrically operated outboard-type motor, indicated generally by the reference numeral 27 and shown in detail in FIGS. 1 and 9. The motor 27 is mounted on a steering post 28 to the rear of the passenger compartment 15 and depends into the water. The electric motor 27 drives a propeller 29 for a propulsion of the watercraft. In addition, the mounting 28 permits pivotable movement of the electric motor 27 and propeller 29 for steering purposes. To provide control for the outboard motor 27, there is provided a steering arm 31 which is affixed to the steering shaft 28 and which is coupled to one end of a wire actuator 32 that is contained within a protective sheet 33, the entire wire actuator assembly being indicated by the reference numeral 34. The wire actuator 34 extends into the passenger compartment 15 and therein the other end of the control wire 32 is connected to a control handle, indicated generally by the reference numeral 35 which has a somewhat handlebar shape and has a control handle grip 36 and a base portion 37 that is pivotally supported on a bracket 38, fixed within the passenger's compartment 15 in a suitable manner, by a pivot pin 39. As a result, pivotal movement of the steering handle 35 will affect steering of the outboard motor 27 and the watercraft as is well known. In addition, any suitable throttle control may be employed for controlling the speed of the electric outboard motor 27.

A battery 41 as positioned within the passenger compartment 15, conveniently beneath the seat 16 for providing the necessary electrical power for the outboard motor 27.

It should be noted that the hatch cover 39 is also formed in large part from a transparent material such as glass or any of the aforenoted types of transparent high-strength plastic. As a result, even when the hatch cover 19 is closed, the water-craft 11 may be operated by the operator standing on the seat 16 as shown in the phantom-line view in FIG. 1. This position can be used favorably for docking or the like.

From the foregoing description, it should be readily apparent that the described semi-submerged watercraft is a highly versatile water vehicle and one which permits viewing of both underwater scenes and also operation from a seated operator. These results are achieved without the necessity of the high cost attended with submersible vehicles. Of course, the foregoing description is that of a preferred embodiment of the invention and various changes and modifications may be made without departing from the spirit and scope of the invention, as defined by the appended claims.

I claim:

1. A semi-submerged watercraft having a hull defining a rider's compartment for accommodating at least a single rider seated below the water level, the buoyancy of said watercraft being such that a seated rider's eyes are substantially at water level at all times when said watercraft is in a body of water of sufficient depth for said watercraft to float in its semi-submerged condition, a hatch positioned above the water level for entry and exit of the rider, said hull having an underwater porthole through which a rider may view underwater scenes when seated in said rider's compartment, and an above-the-water porthole formed by said hull through which said rider may determine his course when seated in said rider's compartment for operating said watercraft.

2. A semi-submerged watercraft as set forth in claim 1 wherein the rider's compartment is provided with a seat on a floor thereof.

3. A semi-submerged watercraft as set forth in claim 1 further including propulsion means for propelling the watercraft.

4. A semi-submerged watercraft as set forth in claim 3 wherein the propulsion means comprises an outboard-mounted engine controllable from the rider's compartment.

5. A semi-submerged watercraft as set forth in claim 4 wherein the rider's compartment is provided with a seat on a floor thereof.

6. A semi-submerged watercraft as set forth in claim 5 wherein watercraft controls are positioned to be operable by the rider when standing within the rider's compartment.

7. A semi-submerged watercraft as set forth in claim 6 wherein the hatch is closed by a removable hatch cover that is transparent and at a height that the standing rider's head will be within the hatch cover and the rider may see through the hatch cover when operating the watercraft in a standing position.

8. A semi-submerged watercraft as set forth in claim 7 wherein the propulsion means for the watercraft is an electrically-operated motor.

9. A semi-submerged watercraft as set forth in claim 8 wherein the electrically-operated motor is powered by a battery positioned beneath the seat in the rider's compartment.

10. A semi-submerged watercraft as set forth in claim 9 further including a pair of wing configured floats secured to opposite sides of the hull at approximately the water level for offering stability and flotation to the hull.

11. A semi-submerged watercraft as set forth in claim 1 further including a pair of wing configured floats secured to opposite sides of the hull at approximately the water level for offering stability and flotation to the hull.

12. A semi-submerged watercraft as set forth in claim 11 wherein the hull and floats are formed from a fiberglass reinforced resin and wherein the floats are hollow and filled with a foamed plastic.

13. A semi-submerged watercraft as set forth in claim 9 wherein the standing rider stands on the seat at a position between the battery and the electrically operated motor.

14. A semi-submerged watercraft as set forth in claim 11 wherein the portion of the hull submerged extends generally in a forward direction from the seat in generall perpendicular relation to the wing configured floats for maintaining good stability for the watercraft.

15. A semi-submerged watercraft as set forth in claim 10 wherein the portion of the hull submerged extends generally in a forward direction from the seat in generally perpendicular relation to the wing configured floats for maintaining good stability for the watercraft.

16. A semi-submerged watercraft as set forth in claim 6 wherein the rider stands on the seat to operate the watercraft in the standing position.

* * * * *